US009926669B2

(12) United States Patent
White

(10) Patent No.: US 9,926,669 B2
(45) Date of Patent: Mar. 27, 2018

(54) ROUND SHAFT TRACK GUIDE AND TRACK ASSEMBLY

(71) Applicant: Schaeffler Technologies AG & Co. KG, Herzogenaurach (DE)

(72) Inventor: Carl White, Fort Mill, SC (US)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 436 days.

(21) Appl. No.: 14/680,171

(22) Filed: Apr. 7, 2015

(65) Prior Publication Data

US 2015/0292166 A1 Oct. 15, 2015

Related U.S. Application Data

(60) Provisional application No. 61/977,219, filed on Apr. 9, 2014.

(51) Int. Cl.
*E01B 23/04* (2006.01)
*E01B 9/60* (2006.01)

(52) U.S. Cl.
CPC ..... *E01B 23/04* (2013.01); *E01B 9/60* (2013.01)

(58) Field of Classification Search
CPC . E01B 23/04; E01B 9/60; E01B 23/00; E01B 23/02; E01B 11/02; F16L 3/24; F16L 3/1066; F16L 3/127; F16L 3/13
USPC .... 238/10 R, 10 E, 282, 280, 278, 277, 275, 238/264; 191/23 R, 28, 32, 31, 29 DM, 191/33 PM, 40
See application file for complete search history.

(56) References Cited

U.S. PATENT DOCUMENTS 6,371,419 B1 * 4/2002 Ohnuki ..... F16L 3/13 248/71
6,883,762 B2 * 4/2005 Miura ..... B60R 16/0215 248/62

* cited by examiner

*Primary Examiner* — Mark T Le
(74) *Attorney, Agent, or Firm* — Volpe and Koenig, P.C.

(57) ABSTRACT

An assembly and method for removably installing a round linear track to a floor is provided. The assembly includes a track guide having a plurality of curved bearing surfaces to support a round track segment and a clamp to removably capture the round track in the track guide. The method includes placing a segment of round track on a lead portion of the track guide; moving the segment of track into a supporting portion of the track guide; and capturing the segment of round track in the track guide with a clamp.

20 Claims, 5 Drawing Sheets

ROUND SHAFT TRACK GUIDE AND TRACK ASSEMBLY

CROSS REFERENCE TO RELATED APPLICATIONS

This application claims the benefit of U.S. Patent Application No. 61/977,219 filed on Apr. 9, 2014, which is incorporated by reference as if fully set forth.

FIELD OF INVENTION

The present invention generally relates to track assemblies for material handling carts. More particularly, the present invention relates to a base structure and single clamping element for fixing the linear shaft in position and a track assembly using the base structure and a single clamping element.

BACKGROUND

When moving parts or equipment in an industrial facility, carts designed to follow a network of track sections are often used. The track sections usually have a circular cross section and are installed in sections. A roller assembly includes a wheel with a concave circumferential surface for engaging and rolling on a portion of the track sections, facilitating movement of the load.

Typically the track sections are embedded in a facility floor and grouted in place. Removal or a typical system requires excavation of the entrenched system.

An alternate system provides track sections supported by a base having a flat mounting surface rigidly held to a facility floor with fasteners and grouted into a trough in the floor. A profile in the base accepts the track section and two separate and opposing clamps are placed on either side of the track section, between the track section and an outer wall of the base, to center the track and hold it in place. A portion of each clamp having an engagement profile is inserted into the base to a variable depth of penetration and held in place by a corresponding engagement profile on the base. The two opposing clamps exert opposite forces that vary with the insertion depth and must be carefully adjusted during installation to properly position the track.

In order to remove the track section, the two clamps are cut generally parallel to the length of track and removed, freeing the section of track for removal. A replacement track segment is placed in the base and two new clamps installed to hold the track in place, requiring the same careful adjustment Known bases typically have a flat bottom mounting surface to rest on a substantially flat portion of the floor or the trough in the floor. For some applications, specifically for carts used to carry very large loads, the flat mounting surface does not provided adequate contact surface to distribute the weight of the load over a sufficiently large area. As a result, the base may deform, the floor material, usually concrete, may crack, or both, leading to an expensive and time consuming repair.

Accordingly, a need exists for a track assembly overcoming the drawbacks of the current systems.

SUMMARY

A round track shaft guide, a track assembly including the round track shaft guide, and a method of using the assembly are provided herein. In one embodiment, the track comprises a base having a top side and a raised center section on the top side with a curved upper surface. The raised center section is bounded by a first side wall and a second side wall. In a preferred embodiment, a first arm extends from the top side adjacent to the first side wall and has a first projection extending towards the first side wall. A second arm preferably extends from the top side adjacent to the second side wall and has a second projection extending towards the second side wall with the second projection having a curved bearing surface. In a preferred embodiment the curved upper surface and the curved bearing surface are arc segments of a common circle.

In an embodiment a track assembly comprises a track guide having a base with a top side, a raised center section on the top side bounded by a first side wall and a second side wall with a curved upper surface comprising a first curved support surface and a second curved support surface. A portion of the first side wall included a first engagement profile. A first arm extends from the top side adjacent to the first side wall and has a first projection extending towards the first side wall, the first projection having a first flat bearing surface. A second arm extends from the top side adjacent to the second side wall and has a second projection extending towards the second side wall, with the second projection having a first curved bearing surface laying on a common circle with the curved upper surface. And providing a clamp having an elongate arm with a first end including a second engagement profile on a first side, the second engagement profile is engagable with the first engagement profile. The clamp has a second end comprising a projection formed on the first side with a second curved bearing surface and a second flat bearing surface formed on a second side of the elongate arm.

In an embodiment, a method of using a track assembly to removably install a round linear track is provided. The method comprises providing a track assembly including a track guide having a base with a top side, a raised center section on the top side bounded by a first side wall and a second side wall with a curved upper surface comprising a first curved support surface and a second curved support surface. A portion of the first side wall includes a first engagement profile. A first arm extends from the top side adjacent to the first side wall and has a first projection extending towards the first side wall, the first projection having a first flat bearing surface. A second arm extends from the top side adjacent to the second side wall and has a second projection extending towards the second side wall, with the second projection having a first curved bearing surface laying on a common circle with the curved upper surface. A clamp having an elongate arm with a first end including a second engagement profile on a first side is provided, the second engagement profile is engageable with the first engagement profile. The clamp has a second end comprising a projection formed on the first side with a second curved bearing surface and a second flat bearing surface formed on a second side of the elongate arm.

A round track segment is positioned in an opening between the first flat bearing surface and the first curved bearing surface with a center of the round track segment offset from a center of the curved upper surface.

The round track segment is lowered to contact an inclined lead extending from the first side wall to a termination of the first curved support surface.

The round track segment is displaced to be in contact with the first and the second curved support surfaces, and the first curved bearing surface.

Once the round track segment is in contact with the first and the second curved support surfaces, and the first curved bearing surface, the clamp is positioned in the opening with the first end entering the opening. The clamp is advanced towards the base to engage the first engagement profile with the second engagement profile, and to abut the first flat bearing surface against the second flat bearing surface, bringing the second bearing surface into contact with the round track segment, capturing the round track segment in the track guide.

Other and further embodiments of the present invention are described below.

BRIEF DESCRIPTION OF THE DRAWINGS

Embodiments of the present invention, briefly summarized above and discussed in greater detail below, can be understood by reference to the illustrative embodiments of the invention depicted in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
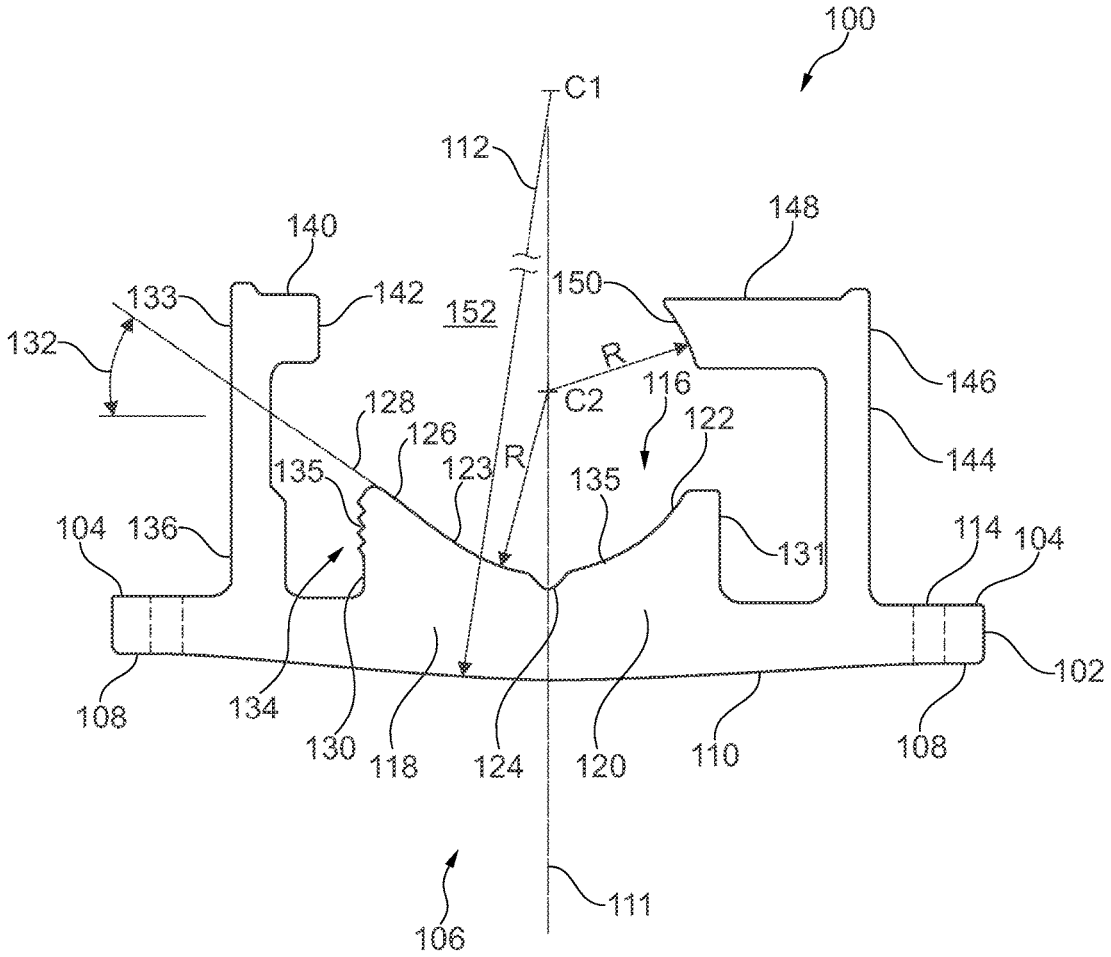
FIG. 1 is an end view of a base in accordance with an embodiment of the present invention.

To facilitate understanding, identical reference numerals have been used, where possible, to designate identical elements that are common in the figures. The figures are not drawn to scale and may be simplified for clarity. It is contemplated that elements and features of one embodiment may be beneficially incorporated in other embodiments without further recitation.

While described in reference to track having a circular cross section, the present invention may be modified for a variety of applications having other track cross sections while remaining within the spirit and scope of the claimed invention, since the range of the potential applications is great, and because it is intended that the present invention be adaptable to many such variations.

FIG. 1 is a non-limiting end view of a track guide 100 in accordance with an embodiment of the present invention. In a preferred embodiment, the track guide 100 is formed from a metal, for example aluminum or an alloy of aluminum, in an extrusion process. The track guide 100 has a base 102 having a generally planar top side 104 and an opposing bottom side 106. The generally planar edge portions 108 of the bottom side 106 are parallel to the top side 104. A convex down (as drawn) curved center portion 110 extends between the edge portions 108 and has a radius 112 centered at C1 on axis 111 on a side opposite the bottom side 106 (i.e., adjacent to the top side 104) of the base 102. The curved center portion 110 provides a bearing surface for the track guide 100 to better distribute loads applied to the track guide further discussed below. A plurality of passages 114 are formed between the top side 104 and the edge portions 108 of the bottom side 106 for fastening or leveling the base 102 to a facility floor (not shown).

The top side 104 of the base 102 includes a raised center section 116 comprising a first portion 118 and a second portion 120 bounded by first and second side walls 130, 131, respectively. The curved upper surface 122 of first and second portions 118, 120 has a radius R centered at C2 which lies on axis 111. A relief 124, for example a rounded bottomed channel, is formed between and separates the first portion 118 and the second portion 120. The relief 124 interrupts the curved support surface 123 of the first portion 118 and the curved support surface 125 of the second portion 120 as illustrated, creating a discontinuity in the upper surface 122.

In the first portion 118, the curved support surface 123 extends from the relief 124 to an inclined lead 126 which extends from the termination of radius R to an outside corner 128 formed between the lead 126 and the first side wall 130. In a preferred embodiment, the lead 126 is a straight section inclined at an angle 132 from a horizontal axis x as shown in FIG. 1. The angle 132 may be between about 25 degrees and about 45 degrees, for example about 35 degrees.

An engagement profile 134 is formed on a portion of the first side wall 130. The engagement profile 134 may one or more serrations, or teeth 135, as shown in FIG. 1. The crests and roots of the teeth 135 are linear and generally perpendicular to the plane of the page as drawn. In a preferred embodiment the teeth of the engagement profile 134 are angled toward the base 102 (i.e., downwardly as drawn).

The base 102 includes a first arm 136 extending from the top side 104 of the base 102 adjacent to and spaced apart from the first side wall 130. A second arm 144 extends from the top side 104 of the base 102 adjacent to and spaced apart from the second side wall 131. A top portion 138 of the first arm 136 includes a projection 140 extending towards the first side wall 130 and the second arm 144. The projection 140 has a flat bearing surface 142 parallel to the axis 111.

A top portion 146 of the second arm 144 includes a projection 148 extending toward the second side wall 131 and the first arm 136. The projection 148 has a radiused or curved bearing surface 150 with the same radius R centered at C2 as the upper surface 122 of the center section 116 (i.e., lie on a common circle). The curved support surface 123, the curved support surface 125, and the curved bearing surface 150 therefore are arc segments or lengths of a common circle centered at C2.

The curved bearing surface 150 is spaced apart from the flat bearing surface 142 forming an opening 152. In a preferred embodiment, the flat bearing surface 142 and the curved bearing surface 150 are spaced apart a distance greater than twice the radius R.

Figure 2:
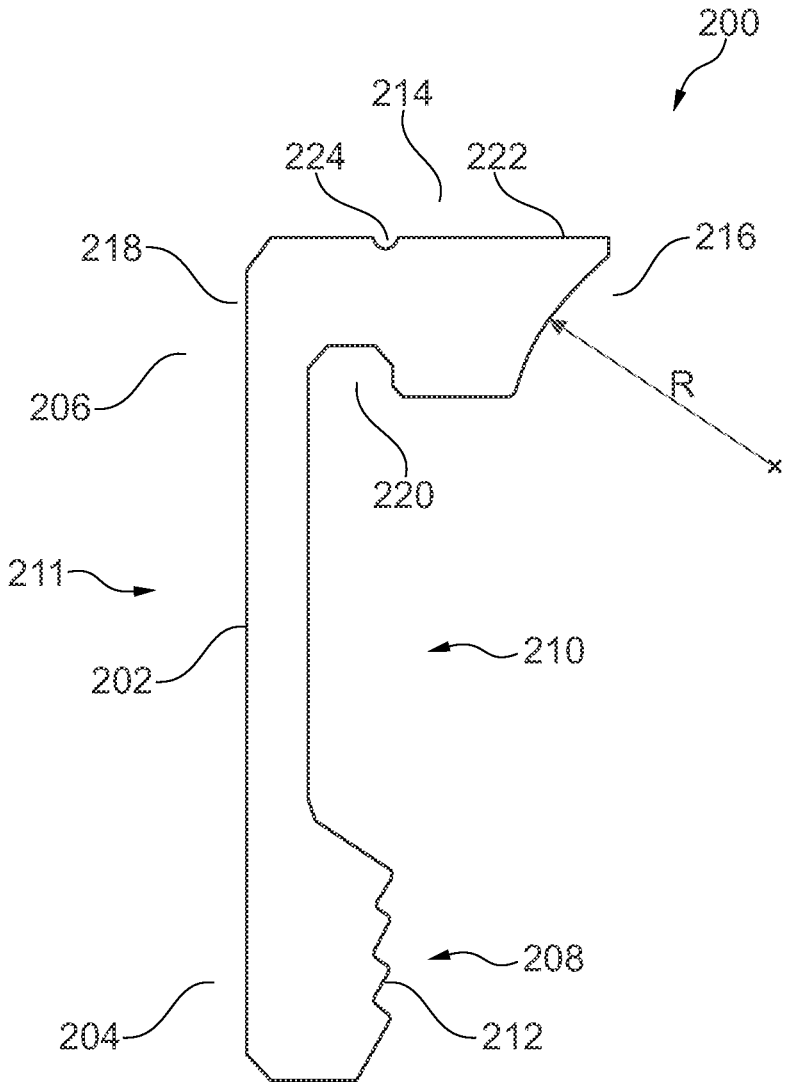
FIG. 2 is an end view of a clamp used in conjunction with the base of FIG. 1 in accordance with an embodiment of the present invention.

FIG. 2 is an end view of a clamp 200 configured to cooperate with the track guide 100 in accordance with an embodiment of the present invention. According to one embodiment, the clamp 200 is formed from a metal, for example aluminum or an alloy of aluminum, by extrusion as an extruded metal profile. Forming the track guide 100 by extrusion imparts several desirable physical characteristics to the track, such as strength because of unity of construction, thereby eliminating the need for fasteners of joining processes.

The clamp 200 includes an elongate arm 202 having a first end 204 and a second end 206. An engagement profile 208 is formed on the first side 210 of the elongate arm 202 on a portion of the first end 204. The engagement profile 208 is configured to cooperate with the engagement profile 134 on the first side wall 130 to allow displacement in one direction and to resist or prevent displacement in the opposite direction. In a preferred embodiment, the engagement profile 208 has one or more serrations, or teeth 212, similar in size and shape to teeth 135 on the engagement profile 134, with the teeth 135 angled toward the second end 206 (i.e., upwardly as drawn) as shown in FIG. 2. The crests and roots of the teeth 212 are linear and generally perpendicular to the plane of the page as drawn. The teeth 212 are configured to engage the teeth 135 with the crests of the teeth 212 engaging the root of teeth 135 and the crests of teeth 135 engaging the root of teeth 212. When engaged, the teeth 135/212 prevent, or substantially prevent, relative motion between the clamp 200 and the track guide 100 perpendicular to the direction of the crests and roots of the teeth.

The second end 206 of the clamp 200 includes a projection 214 formed on the first side 210 of the clamp. The projection 214 has a curved bearing surface 216 directed away from the elongate arm 202. In a preferred embodiment, the curved bearing surface 216 has a radius R, corresponding to the radius R of the curved bearing surface 150 and the upper surface 122.

A flat bearing surface 218 is formed at the second end 206 of the clamp on the second side 211 opposing curved bearing surface 216. In operation, the clamp 200 is positioned with the track guide 100 such that bearing surface 218 is abutting flat bearing surface 142 and the engagement profiles 134, 208 are in opposition such that the teeth 135, 212, respectively, are engaged. When the clamp 200 is properly placed in the track guide 100, the curved bearing surface 216, curved support surface 123, curved support surface 125, and curved bearing surface 150 provides four arc lengths of a common circle centered at C2.

An undercut 220 is provided at the intersection of the arm 202 and the projection 214 adjacent to the first side 210. A notch 224 formed in an upper surface 222 of the projection 214 is aligned with a portion of the undercut 220. The notch 224 may serve as a visual indicator on the upper surface 222 of the undercut 220. As illustrated in FIG. 2, the notch 224 is aligned with an edge of the undercut 220.

The clamp 200 may be formed as individual pieces with several clamps 200 used along a length of track guide 100. In a preferred embodiment, the clamp 200 is formed in a length substantially the same length as the track guide 100.

Figure 3A:
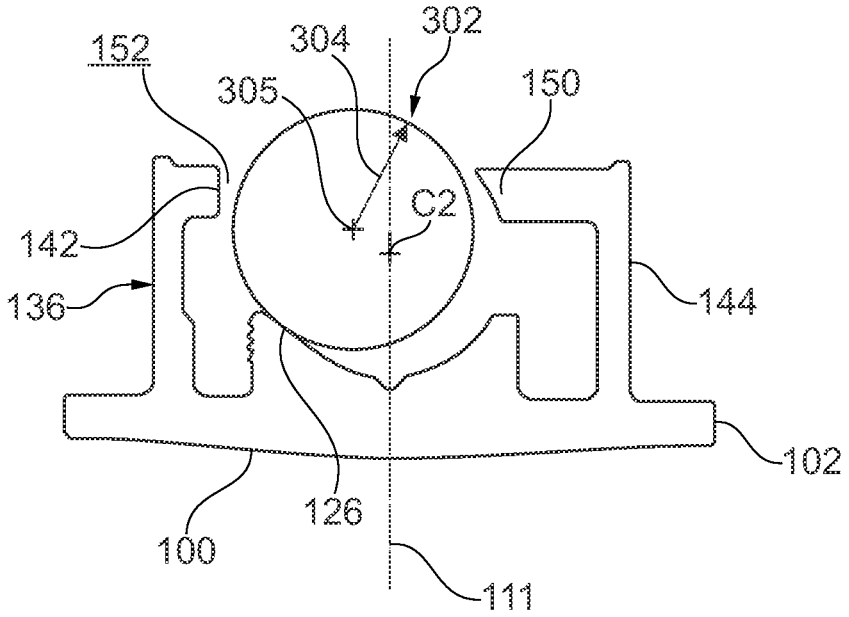
FIGS. 3A-3D are end views of a track assembly in various stages of assembly in accordance with an embodiment of the present invention.

The assembly of track guide 100 and clamp 200 may find application in system using round segments of linear track. FIGS. 3A-3D and FIG. 4 are illustrative of an application of a track assembly comprising the track guide 100 and the clamp 200. As illustrated in FIG. 3A, a segment of round track 302 having radius 304 is received in the opening 152 between flat bearing surface 142 and curved bearing surface 150 and positioned on lead 126. The round track 302 is initially positioned in the opening 152 with the center 305 offset from the axis 111 on which the center C2 of the curved support surfaces 123 and 125 lies and lowered until contact with the lead 126 is established. The lead may advantageously provide clearance to facilitate the placement of the track 302 on the curved support surfaces 123, 125.

Figure 3B:
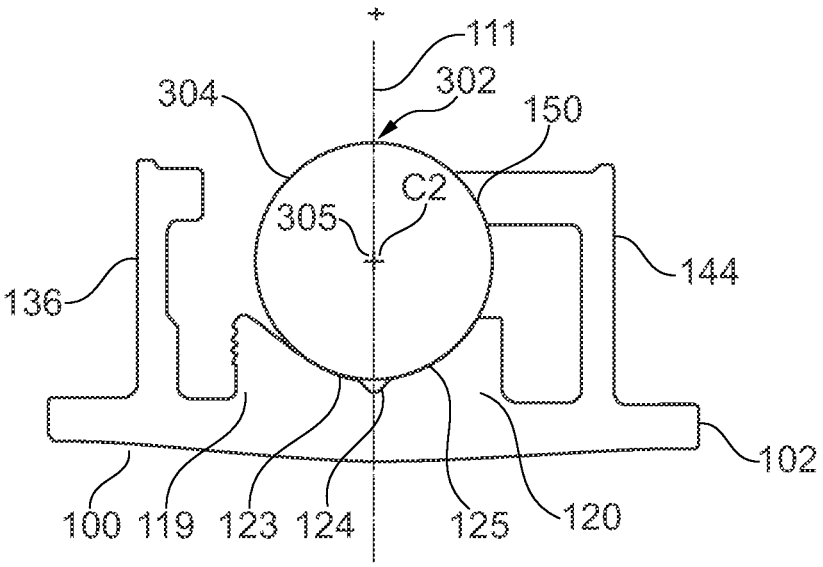

The segment of round track 302 is displaced to be supported by the curved support surface 123 of the first portion 118, the curved support surface 125 of the second portion 120, and the curved bearing surface 150 as illustrated in FIG. 3B. In the supported position of FIG. 3B, the center 305 of the round track segment 302 is aligned with the axis 111 and center C2

Because of the relief 124, the track 302 is not supported on a vertical (as drawn) diameter which could develop a point load of the track 302. Instead, the track 302 is supported by the two curved support surfaces 123, 125 to distribute the weight of the track 302 and any load supported thereon.

Figure 3C:
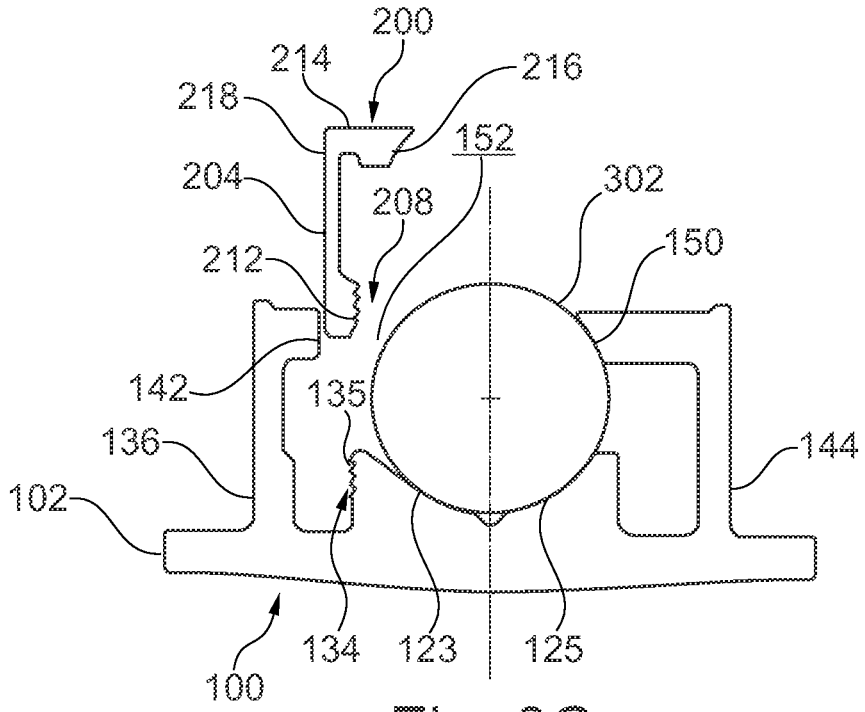

With the segment of round track 302 supported by curved support surfaces 123, 125, and 150, clamp 200 is positioned in the portion of opening 152 between the segment of track 302 and the flat bearing surface 142, with the first end 204 entering the opening 152 as illustrated in FIG. 3C. The clamp 200 is advanced towards the base 102, for example driven by a hammer, so the engagement profile 208 on the clamp 200 is adjacent to the engagement profile 134 on the track guide 100. The first of the teeth 212 in the advancing direction contacts the uppermost of the teeth 135 on the track guide 100. The arm 202 deflects to allow at least one of the advancing teeth 212 to pass at least one of the teeth 135 so the opposing teeth 135, 212 can engage. The configuration of the teeth 135 and 212 allows displacement of the clamp in the advancing direction. Displacement of the clamp in a direction opposite the advancing direction is prevented by the engagement of the track guide teeth 135 with the clamp teeth 212.

Figure 3D:
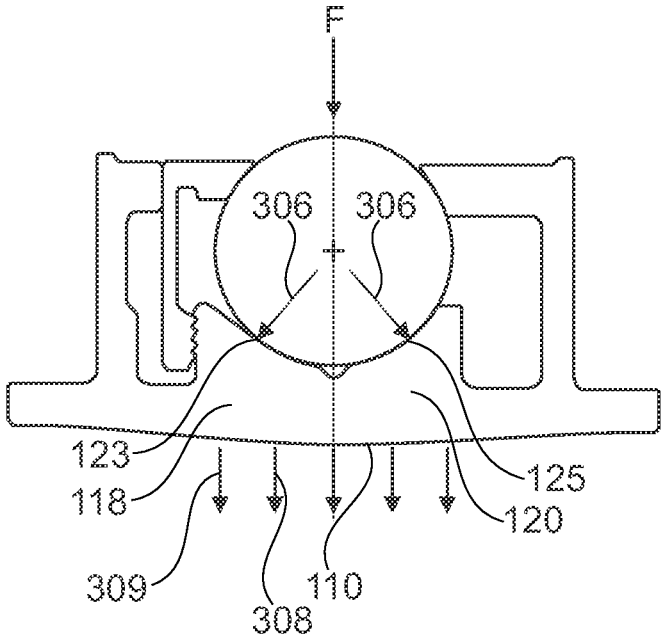

The clamp 200 is advanced until the curved bearing surface 216 contacts the track 302 and flat bearing surface 218 abuts flat bearing surface 142 as illustrated in FIG. 3D. Further advancement of the clamp 200 deflects one or more of the first arm 136 and the second arm 144 capturing the segment of track 302 in the track guide 100. The engagement profiles 134, 208 cooperate to hold the clamp 200 in position. As illustrated in FIG. 3D, a force F resulting from the weight of the track 302 and any load supported by the track is distributed to curved support surfaces 123, 125 in direct contact with the track 302. The force is distributed through the first and second portions 118, 120 as illustrated by force arrows 306, and distributed to a supporting structure (not shown), such as the floor of a facility, as illustrated by force arrows 308 normal to the curved center portion 110.

Removal of the track 302 is achieved by cutting the projection 214 to release the captive track segment 302. Proper location for the cut can be indicated by notch 224 (FIG. 2) formed in an upper surface 222 of the projection 214 is aligned with a portion of the undercut 220. The notch 224 positions the cut in a portion of the undercut 220 to facilitate completion of the cut and removal of the projection 214. After removal of the projection 214, the engagement profiles 134, 208 can be separated and the remaining portion of the clamp 200 removed from the track guide 100, releasing the track 302.

Replacement of a removed segment of track with a replacement round track segment can be accomplished in a similar fashion to installation process. Advantageously, the disclosed track guide provides two curved support surfaces 123,125 and a curved bearing surface 150 to support and position the track 302. Thus one clamp 200 can capture the track 302, reducing the number of parts and labor required for installing the track using the inventive track guide assembly.

Figure 4:
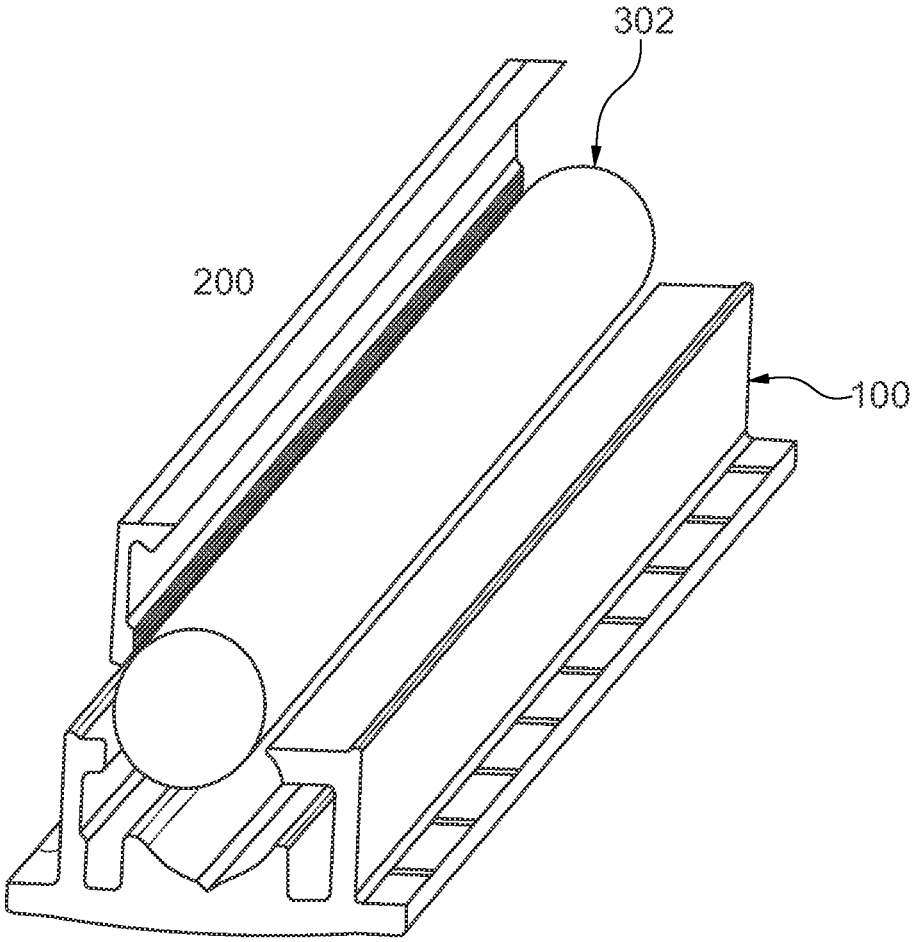
FIG. 4 is a perspective view of a part of a track assembly shown during assembly.

FIG. 4 illustrates a part of a track assembly shown during assembly in perspective view. The round track segment 302 is positioned above the track guide 100 similar to the position illustrated in FIG. 3A. The clamp 200 is positioned adjacent to the round track segment 302 and above the track guide 100 similar to the illustration of FIG. 3C.

Those of ordinary skill in the art may recognize that many modification and variations of the above may be implemented without departing from the spirit or scope of the following claims. For example, although reference to an automotive transmission is made, other mechanical systems sensitive to thermal conditions for optimum performance may benefit from the disclosed fluid control valve and valve system.

What is claimed is:

1. A track guide comprising:

a base having a top side;

a raised center section centered at a central vertical axis on the top side with a curved upper surface and bounded by a first side wall and a second side wall;

a first arm extending from the top side adjacent to the first side wall and having a first projection extending inwardly and away from the first arm, the first projection having a first flat bearing surface parallel to the central vertical axis; and a second arm extending from the top side adjacent to the second side wall and having a second projection extending inwardly and away from the second arm, the second projection having a curved bearing surface, wherein the curved upper surface and the curved bearing surface are arc segments of a common circle.

2. The track guide of claim 1, wherein the raised center section comprises a first portion bounded by the first wall and a second portion bounded by the second side wall, with a relief separating the first portion from the second portion.

3. The track guide of claim 1, further comprising an engagement profile formed on a portion of the first side wall.

4. The track guide of claim 3, wherein the engagement profile comprises one or more teeth, each tooth having a crest and a root.

5. The track guide of claim 1, wherein the raised center section includes an inclined lead extending from the first side wall to a termination of the curved upper surface.

6. A track guide comprising:

a base having a top side;

a raised center section on the top side with a curved upper surface and bounded by a first side wall and a second side wall;

a first arm extending from the top side adjacent to the first side wall and having a first projection extending inwardly and away from the first arm; and a second arm extending from the top side adjacent to the second side wall and having a second projection extending inwardly and away from the second arm, the second projection having a curved bearing surface, wherein the curved upper surface and the curved bearing surface are arc segments of a common circle, wherein the base has a second side comprising planar edge portions and a curved center portion extending between the edge portions and having a radius centered at a point opposite the second side of the base.

7. The track guide of claim 1, wherein the base, the raised center section, the first arm, and the second arm are formed from a metal as an extruded profile.

8. The track guide of claim 7, wherein the metal comprises aluminum.

9. A track assembly comprising:

a track guide having a base with a top side and further including:

a raised center section on the top side bounded by a first side wall and a second side wall with a curved upper surface comprising a first curved support surface and a second curved support surface, a portion of the first side wall including a first engagement profile;

a first arm extending from the top side adjacent to the first side wall and having a first projection extending inwardly and away from the first arm, the first projection having a first flat bearing surface;

a second arm extending from the top side adjacent to the second side wall and having a second projection extending inwardly and away from the second arm, the second projection having a first curved bearing surface laying on a common circle with the curved upper surface; and a clamp having an elongate arm with a first end including a second engagement profile, engageable with the first engagement profile, on a first side and a second end comprising a projection formed on the first side with a second curved bearing surface and a second flat bearing surface formed on a second side of the elongate arm.

10. The assembly of claim 9, wherein the first engagement profile and the second engagement profile cooperate to allow displacement of the first end of the clamp with respect to the track guide in a first direction towards the base and resist displacement in an opposite second direction.

11. The assembly of claim 9, wherein the raised center section comprises a first portion bounded by the first wall and a second portion bounded by the second side wall, with a relief separating the first portion from the second portion.

12. The assembly of claim 9, wherein the first engagement profile comprises one or more teeth configured to engage one or more teeth of the second engagement profile.

13. The assembly of claim 9, wherein the raised center section includes an inclined lead extending from the first side wall to a termination of the curved upper surface.

14. The assembly of claim 13, wherein the lead is inclined from a horizontal axis by an angle of about 35 degrees.

15. The assembly of claim 9, wherein the base has a second side comprising planar edge portions and a curved center portion extending between the edge portions and having a radius centered at a point opposite the second side of the base.

16. A method of using a track assembly to removably install a round linear track comprising:

providing the track assembly of claim 9;

positioning a round track segment in an opening between the first flat bearing surface and the first curved bearing surface with a center of the round track segment offset from a center of the curved upper surface;

lowering the round track segment to contact an inclined lead extending from the first side wall to a termination of the first curved support surface;

displacing the round track segment to be in contact with the first curved support surface and the second curved support surface and the first curved bearing surface;

positioning the clamp in the opening with the first end entering the opening;

advancing the clamp towards the base to engage the first engagement profile with the second engagement profile, and abut the first flat bearing surface against the second flat bearing surface, and bringing the second bearing surface into contact with the round track segment; and capturing the round track segment in the track guide.

17. The method of claim 16, further comprising after capturing the round track segment:

cutting the first projection to release the round track segment;

removing the round track segment from the track guide;

replacing the round track segment with a replacement round track segment;

advancing the clamp towards the base to engage the first engagement profile with the second engagement profile, and abut the first flat bearing surface against the second flat bearing surface, and bringing the second bearing surface into contact with the replacement round track segment; and capturing the replacement round track segment in the track guide.

18. The track guide of claim 6, wherein the raised center section comprises a first portion bounded by the first wall and a second portion bounded by the second side wall, with a relief separating the first portion from the second portion.

19. The track guide of claim 6, further comprising an engagement profile formed on a portion of the first side wall.

20. The track guide of claim 19, wherein the engagement profile comprises one or more teeth, each tooth having a crest and a root.

* * * * *